US007001109B2

(12) United States Patent
Mongrain

(10) Patent No.: US 7,001,109 B2
(45) **Date of Patent: *Feb. 21, 2006**

(54) APPARATUS FOR GROUND SUPPORT

(76) Inventor: Rock Mongrain, 154, 14e Rue, Rouyn-Noranda, Quebec (CA) J9X 2J5

( * ) Notice: Subject to any disclaimer, the term of this patent is extended or adjusted under 35 U.S.C. 154(b) by 0 days.

This patent is subject to a terminal disclaimer.

(21) Appl. No.: 10/727,484

(22) Filed: Dec. 5, 2003

(65) Prior Publication Data

US 2005/0123360 A1 Jun. 9, 2005

(51) Int. Cl.
*E21D 21/00* (2006.01)

(52) U.S. Cl. ..... 405/259.1; 405/302.1; 411/4

(58) Field of Classification Search ..... 405/259.1, 405/259.2, 259.3, 259.4, 259.5, 259.6, 302.1; 411/4

See application file for complete search history.

(56) References Cited

U.S. PATENT DOCUMENTS 4,144,796 A * 3/1979 Richter et al. ..... 411/4
4,173,918 A * 11/1979 Piersall ..... 411/51
5,397,202 A * 3/1995 Shrader et al. ..... 405/259.6
5,885,034 A * 3/1999 Fergusson ..... 405/302.1
6,698,980 B1 * 3/2004 Mongrain ..... 405/259.5

* cited by examiner

*Primary Examiner*—Frederick L. Lagman
(74) *Attorney, Agent, or Firm*—J. Gordon Thomson

(57) ABSTRACT

An improved apparatus for ground support comprising a tensionable reinforcing member including at least one nut threadably receivable by the tensionable reinforcing member. The nut body comprises a squared portion and a convex hemispherical portion. The nut includes a bore adapted for engagement with the first end threaded portion of the tensionable reinforcing member. The nut also at least one second bore transversing the squared portion of the nut square body portion. The second bore is adapted to accept a shearing element capable to fix the nut in a temporary first operating position on the reinforcing member. The shearing element is a rolled member made from carbon steel. The shearing element is adapted to shear at a consistent and predetermined torque$_{shear}$.

11 Claims, 18 Drawing Sheets

FJT1

FJT5

TORQUE STUDY "FJT-1"

| | | | | | | | | | |
|---|---|---|---|---|---|---|---|---|---|
| 1. | 85 | 11. | 100 | 21. | 90 | 31. | 93 | 41. | 105 |
| 2. | 70 | 12. | 80 | 22. | 70 | 32. | 92 | 42. | 100 |
| 3. | 65 | 13. | 90 | 23. | 115 | 33. | 95 | 43. | 100 |
| 4. | 85 | 14. | 95 | 24. | 60 | 34. | 80 | 44. | 100 |
| 5. | 90 | 15. | 150 | 25. | 110 | 35. | 75 | 45. | 130 |
| 6. | 60 | 16. | 90 | 26. | 102 | 36. | 100 | 46. | 80 |
| 7. | 80 | 17. | 100 | 27. | 80 | 37. | 110 | 47. | 100 |
| 8. | 150 | 18. | 135 | 28. | 65 | 38. | 70 | 48. | 95 |
| 9. | 90 | 19. | 90 | 29. | 112 | 39. | 90 | 49. | 100 |
| 10. | 100 | 20. | 100 | 30. | 95 | 40. | 90 | 50. | 115 |

| | |
|---|---|
| Average: | **94,5** |
| Std Deviation: | **19,6** |
| Average Range: | **14,1** |

TORQUE STUDY "FJT-5"

| | | | | | | | | | |
|---|---|---|---|---|---|---|---|---|---|
| 1. | 125 | 11. | 90 | 21. | 95 | 31. | 95 | 41. | 85 |
| 2. | 115 | 12. | 95 | 22. | 60 | 32. | 85 | 42. | 90 |
| 3. | 85 | 13. | 100 | 23. | 110 | 33. | 90 | 43. | 100 |
| 4. | 85 | 14. | 85 | 24. | 90 | 34. | 90 | 44. | 70 |
| 5. | 95 | 15. | 90 | 25. | 95 | 35. | 95 | 45. | 100 |
| 6. | 100 | 16. | 96 | 26. | 100 | 36. | 90 | 46. | 85 |
| 7. | 108 | 17. | 90 | 27. | 100 | 37. | 90 | 47. | 80 |
| 8. | 70 | 18. | 105 | 28. | 130 | 38. | 90 | 48. | 80 |
| 9. | 95 | 19. | 80 | 29. | 90 | 39. | 105 | 49. | 100 |
| 10. | 115 | 20. | 95 | 30. | 100 | 40. | 110 | 50. | 80 |

| | |
|---|---|
| Average: | **94,0** |
| Std Deviation: | **12,9** |
| Average Range: | **9,4** |

TORQUE STUDY "PINCH"

| | | | | | | | | | |
|---|---|---|---|---|---|---|---|---|---|
| 1. | 75 | 11. | 80 | 21. | 80 | 31. | 110 | 41. | 85 |
| 2. | 70 | 12. | 75 | 22. | 70 | 32. | 70 | 42. | 75 |
| 3. | 75 | 13. | 75 | 23. | 65 | 33. | 60 | 43. | 60 |
| 4. | 65 | 14. | 60 | 24. | 65 | 34. | 60 | 44. | 75 |
| 5. | 75 | 15. | 75 | 25. | 60 | 35. | 55 | 45. | 110 |
| 6. | 80 | 16. | 90 | 26. | 65 | 36. | 65 | 46. | 60 |
| 7. | 85 | 17. | 75 | 27. | 85 | 37. | 95 | 47. | 60 |
| 8. | 60 | 18. | 65 | 28. | 50 | 38. | 60 | 48. | 65 |
| 9. | 75 | 19. | 55 | 29. | 80 | 39. | 65 | 49. | 90 |
| 10. | 60 | 20. | 65 | 30. | 75 | 40. | 80 | 50. | 80 |

| | |
|---|---|
| Average: | 72,2 |
| Std Deviation: | 12,8 |
| Average Range: | 10,1 |

TORQUE STUDY "TORQBOLT"

| | | | | | | | | | |
|---|---|---|---|---|---|---|---|---|---|
| 1. | 90 | 11. | 90 | 21. | 90 | 31. | 90 | 41. | 95 |
| 2. | 90 | 12. | 100 | 22. | 90 | 32. | 100 | 42. | 95 |
| 3. | 90 | 13. | 95 | 23. | 95 | 33. | 90 | 43. | 95 |
| 4. | 90 | 14. | 95 | 24. | 90 | 34. | 90 | 44. | 90 |
| 5. | 95 | 15. | 90 | 25. | 95 | 35. | 90 | 45. | 95 |
| 6. | 95 | 16. | 95 | 26. | 95 | 36. | 95 | 46. | 100 |
| 7. | 90 | 17. | 95 | 27. | 100 | 37. | 100 | 47. | 95 |
| 8. | 95 | 18. | 95 | 28. | 100 | 38. | 100 | 48. | 95 |
| 9. | 100 | 19. | 100 | 29. | 95 | 39. | 90 | 49. | 95 |
| 10. | 90 | 20. | 100 | 30. | 95 | 40. | 90 | 50. | 90 |

| | |
|---|---|
| Average: | 94,1 |
| Std Deviation: | 3,7 |
| Average Range: | 3,1 |

Figure 18

| JAN 2003 | FEB 2003 | MAR 2003 | APR 2003 | MAY 2003 | JUN 2003 | JUL 2003 | AUG 2003 | SEP 2003 | OCT 2003 | Total |
|---|---|---|---|---|---|---|---|---|---|---|
| 16000 | 6000 | 10000 | 10500 | 12000 | 12000 | 10375 | 9125 | 13600 | 17300 | 92,000 |
| | | | | | | | | | | |
| | | | | | | | | | | |
| | | | | | | | | | | |
| | | | | | | | | | | |

APPARATUS FOR GROUND SUPPORT

CROSS-REFERENCE TO RELATED APPLICATIONS

This application is related to U.S. Pat. No. 6,698,980 entitled "Rock Stabilizing Apparatus and Method", issued on Mar. 2, 2004 currently pending in the United States Patent and Trademark Office.

BACK GROUND OF THE INVENTION

1. Field of the Invention

This invention relates to ground support apparatus used for anchoring unstable rock formations in underground mines. More particularly this invention relates to an improved apparatus for ground support.

2. Background of the Invention

There are a variety of known ground support apparatus and methods for securing unstable rock formations in underground mines. Many of these apparatus and methods rely upon steel reinforcement members placed in pre-drilled holes that are filled with a hardenable resin or cementaceous material. The known ground support apparatus typically comprise a steel reinforcing member as an anchor or length of anchor cable having a nut temporarily fixed at the exposed end of the member or cable. The nut is temporarily fixed in place by a shearing element such as a solid shear pin or a dome nut. Alternatively, the nut is temporarily fixed in position by a "pinched thread" located on the threaded area of the bolt. The "pinched thread" acts to impede the rotation of the nut. At a certain predetermined torque, the threads of the nut are able to transverse the "pinched thread" and continue to advance along the threaded portion of the reinforcing member.

The apparatus is typically placed into the drilled hole and the hardenable adhesion material is added. The nut is engaged with a rotating device to rotate the member until the hardenable fill material stiffens and cures. At some predetermined shearing torque, the shearing element temporarily fixing the nut to the member fails and the nut is permitted to move forward on the threaded portion of the member. There is, typically, a bearing plate between the nut and the rock face. The nut is advanced along the threaded portion of the member until the bearing plate is secured against the face and the member is adequately tensioned.

One example of a known ground support apparatus is described U.S. Pat. No. 4,051,683 "Method and Apparatus For Supporting A Mine Roof" issued to Koval in 1977. Another example is described in U.S. Pat. No. 5,785,463 "Combination Cable Bolt System" issued to Eaton et al in 1998. These inventions, and others employing the same principals of operation, share common deficiencies:

- The shearing torque is inconsistent and may be much higher than anticipated thereby creating problems for the operator who must apply much more torque, often manually, to the nut. This leads to delays in rock anchoring operations and unnecessary expense. Alternatively, the shearing torque may be too low resulting in the hardenable material not property curing and reducing the strength of the installation.
- Steel fragments are known to breakaway from the shearing element especially in dome nuts and especially when excessive and unpredictable torque must be applied to fail the shearing element. These fragments create a safety hazard for the operator and often cause damage to the threads of the reinforcing member or cable. Thread damage prevents additional bearing plates and nuts from being added to the end of the member as may be required for screening operations.
- Known shearing elements have a habit of falling out of the assembled ground support apparatus in shipment thereby rendering them useless once they arrive at the work site.

Therefore there is a continued need for an improved ground support apparatus that overcomes these deficiencies.

OBJECTS OF THE INVENTION

It is an object of the present invention to overcome the deficiencies in the prior art.

Another object of the present invention is to provide an improved apparatus for ground support in which the shearing element consistently and predictably shears at a predetermined shearing torque.

Still another object of the invention is to provide an improved apparatus for ground support having a shearing element that does not cause thread damage or a safety hazard when it fails.

SUMMARY OF THE INVENTION

The objects of the present invention are satisfied through the provision of an improved apparatus for ground support. The improved apparatus comprises an elongated reinforcing member having a threaded portion at one end; and, a reinforcing end adapted to be embedded permanently within a hardenable adhesion material within a drilled hole. The threaded portion and the reinforcing end are at opposite ends of the same member. The reinforcing end is inserted into a drilled hole through the unstable rock formation into stable rock. The drilled hole is sufficiently deep so that when the reinforcing member is entirely inserted into the drilled hole the threaded end is partially inserted into the drilled hole. There is at least one bearing plate member retained on the threaded bolt portion of the reinforcing member. The threaded portion can be rotated through the centre of the plate. The plate can be advanced so that it abuts against the rock face for transmitting compressive forces to the rock face. There is at least one nut threadably advanceable over the threaded portion of the reinforcing member. The nut is molded and has a squared body portion and a convex hemispherical body portion. The square portion of the nut is easily adapted for engagement with a nut driver or other rotation imparting device. As well, the corners of a square nut, as compared to, say, a hexagonal nut, are more resistive to shearing forces generated when large amounts of torque are applied to the nut such as during tensioning of the member. The convex curved face of the hemispherical portion of nut combined with a dome shaped bearing plate permits the installation of the reinforcing member at angles that depart from the vertical. As well, the ability of the domed bearing plate to pivot over the convex face of the nut permits installation of a vertical member where the rock face is not horizontal.

The nut acts to advance the domed bearing plate to the rock face and applies a tensioning force into the reinforcing member when it is tightened against the bearing plate. At least one shearing element is provided within the nut that shearably fixes the nut to a predetermined and variable position on the threaded portion of the reinforcing member. The at least one shearing element is designed to fail at $torque_{shear}$. The nut has a first temporary pre-$torque_{shear}$ operating position where it is fixed to the member-threaded portion by the shearing element thus permitting the nut and member to be rotated as one. The first temporary pre-torque$_{shear}$ operating position is adopted when it is necessary to mix adhesion material within the drilled hole for curing. The nut has a second permanent post-torque$_{shear}$ operating position that is adopted once the shearing element has sheared and the nut is free to advance along the threaded portion of the reinforcing member. This second post-torque$_{shear}$ operating position is adopted when it is necessary to abut the bearing plate against the rock formation and then further torque the nut to torque$_{max}$ thus adding compressive forces to the rock formation through the bearing plate and also adding tensile forces to the reinforcing member anchored within the drilled hole. Torque$_{shear}$ is predetermined and is usually dependent upon the curing properties of the adhesion material. The breakage of the shearing element at torque$_{shear}$ will not damage the threads on the reinforcing member. Additionally, the remnants of the shearing element, once sheared, are retained within their respective bores to eliminate safety hazards that may result from energized pieces of the shearing element acting as projectiles. The shearing element is preferably a rolled steel member.

Further objects and advantages of this invention will become apparent from a consideration of the following drawings, detailed description and claims.

BRIEF DESCRIPTION OF THE DRAWINGS

FIG. 18 shows the available sales history of the invention for 2003 thereby illustrating the filling of long felt want in the market for the invention.

DESCRIPTION OF THE INVENTION

Deficiencies in Known Ground Support Apparatus and Test Results

A significant amount of testing has been done by the inventor to demonstrate the deficiencies of known ground support apparatus and the advantages of the present invention. The test results are provided herein to illustrate the inventive advantages of the invention. The testing was conducted to show the improved consistency of torque$_{shear}$ at which the shearing element of the present invention failed thereby meeting one of the objectives of the invention.

Figure 1:
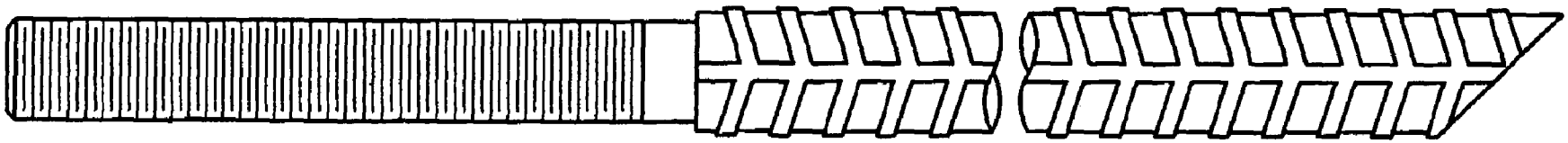
FIG. 1 is a view of a typical reinforcing member used in rock anchoring operations in mines.
Figure 2:
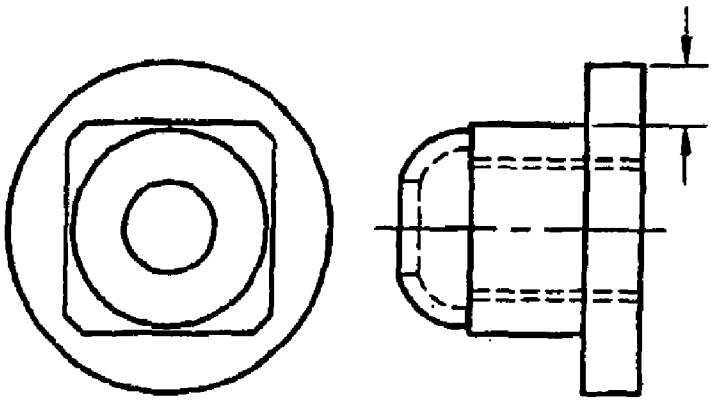
FIG. 2 is a view of the dome nuts FJT-1 and FJT-5 that were tested by the inventor.
Figure 2:
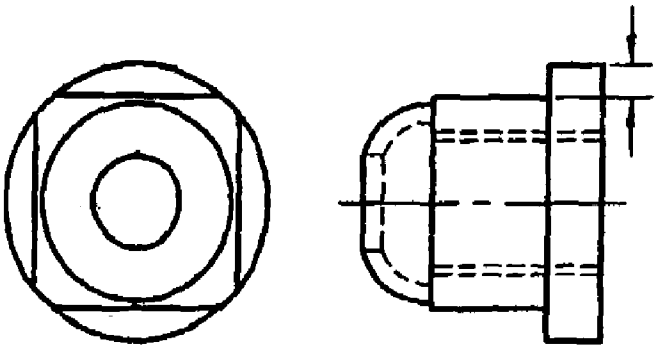

Testing was conducted using two types of standard dome nuts that are commercially available and commonly used in the industry with a standard steel reinforcing member. A typically reinforcing member is illustrated in FIG. 1 showing the threaded portion and the non-threaded portion. FIG. 2 illustrate the FJT 1 and FJT 5 dome nuts used during experimentation. The dome nuts are typically made from a perlitic malleable iron. To install the reinforcing member into the drilled hole, a dome nut is threaded onto the free threaded end of the reinforcing member. The domed portion of the dome nut stops further threading of the nut onto the reinforcing member and the dome nut and reinforcing member can be turned together. In rock anchoring operations, the reinforcing member is usually embedded within a drilled hole containing a curing resin. As the resin is mixed by the rotating reinforcing member it cures and stiffens. The result is that more and more torque is required to turn the reinforcing member in the drilled hole. At a predetermined torque$_{shear}$, the domed portion of the dome nut will fail or shear away permitting the nut to advance down the threaded portion of the reinforcing member. An obvious disadvantage to using the dome nut is that residual elements of the sheared dome portion of the nut may engage the threads of the reinforcing member. This can cause significant damage to the threads and prevent additional nuts from being threaded onto the member. Another disadvantage of the dome nut is the worker hazard associated with sheared pieces of the domed portion of the nut flying away from the nut towards nearby workers.

All of the dome nut tests were conducted in the same manner. A power vice was used to simulate conditions in a drilled hole filled with curing grout or resin. The reinforcing member base was held in the mandrill of the power vice and then the dome nut was installed on the threaded end of the member. A torque wrench was then placed over the nut. The power vice was rotated and a torque wrench was used to measure the torque$_{shear}$ of each sample tested.

The first type of tension dome nut tested was the FJT 1 dome nut. This dome nut is generally used for normal resistance torque mixing applications. The FJT 1 square head dome nut is manufactured by Frazer & Jones and has a rated torque$_{shear}$ of 80 ft-lbs in its ¾ inch left hand thread configuration.

Figure 3:
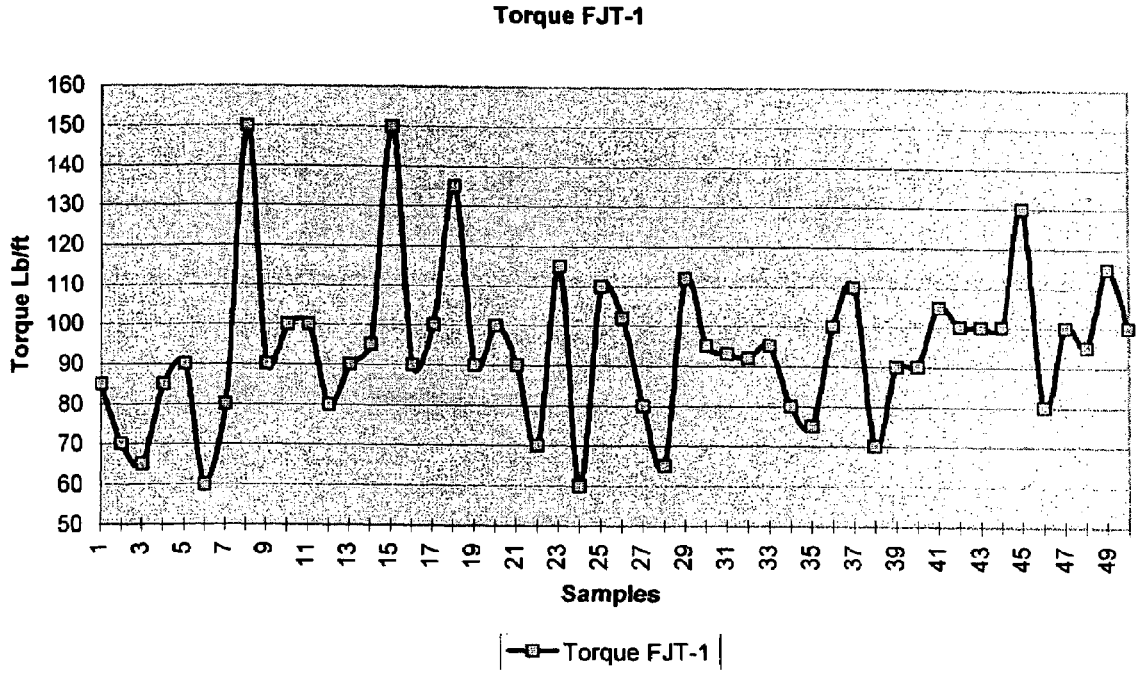
FIG. 3 shows the test results of the FJT-1 dome bolt.

FIG. 3 indicates that the torque$_{shear}$ at which the FJT 1 dome nut shearing device failed ranged from a low of 60 ft-lbs to a high of 150 ft-lbs. A total of 50 samples were tested.

The second type of tension dome nut tested was the FJT-5 which is also used in normal resistance torque mixing operations. The FJT-5 also has a torque$_{shear}$ of 80 ft-lbs. The principle difference between the FJT-1 and the FJT-5 is the size of the nut flange.

Figure 4:
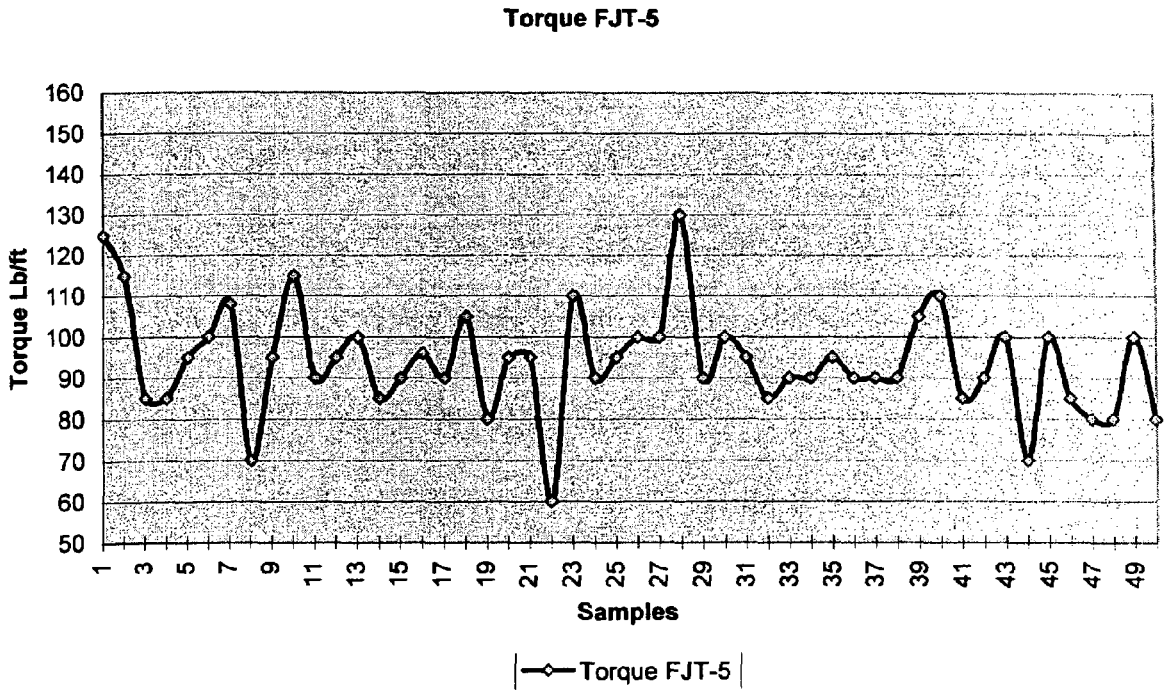
FIG. 4 shows the test results of the FJT-5 dome nut.

Referring to the test results shown on FIG. 4, the torque$_{shear}$ of the FJT-5 dome nut ranged from a low of 60 ft-lbs to a high of 130 ft-lbs with an average of 94 ft-lbs.

Figure 5:
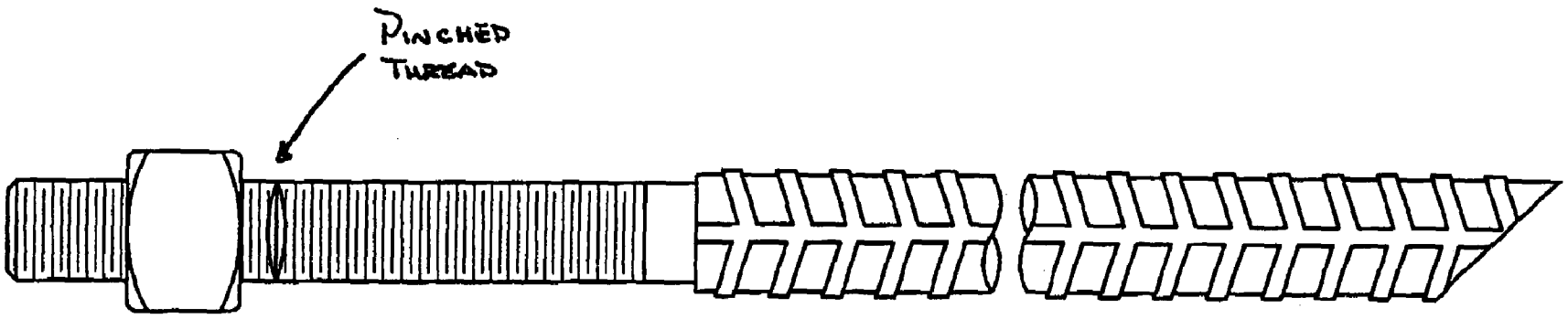
FIG. 5 shows a reinforcing member with a "pinched thread".
Figure 6:
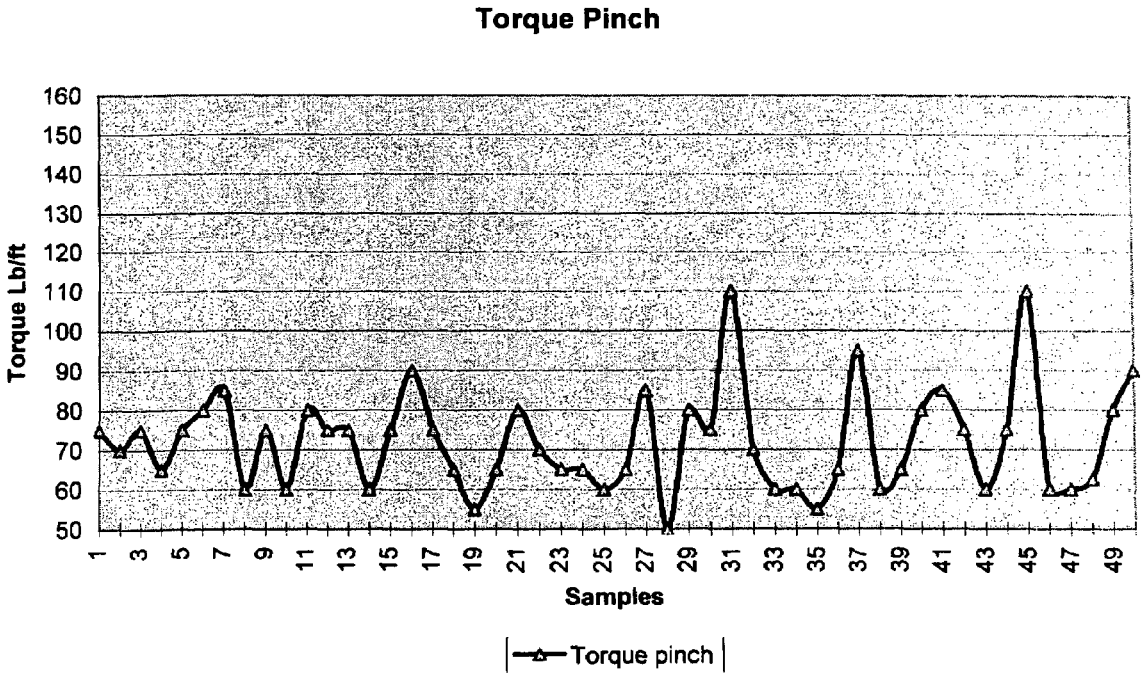
FIG. 6 shows the test results for the "pinched thread".

A third test was conducted using a reinforcing member equipped with a "pinched thread". This type of member is illustrated in FIG. 5. A reinforcing rod with a pinched thread uses a standard square nut. As the square nut is threaded onto the reinforcing bar, it engages the pinched thread and further free rotation of the square nut is prevented. The square nut and rod rotate as one. As the resistance to rotation and torque required to turn the rod increase, the square nut will ultimately be forced over the pinched thread and advance down the threaded portion of the rod. The pinched thread has a rated $torque_{shear}$ of about 80 ft-lbs. FIG. 6 illustrates the test results and shows that the actual $torque_{shear}$ varied from a low of 50 ft-lbs to a high of 110 ft-lbs.

These test results clearly illustrate the deficiencies of the known art ground support apparatus, namely, that their $torque_{shear}$ is not consistent.

Figure 7:
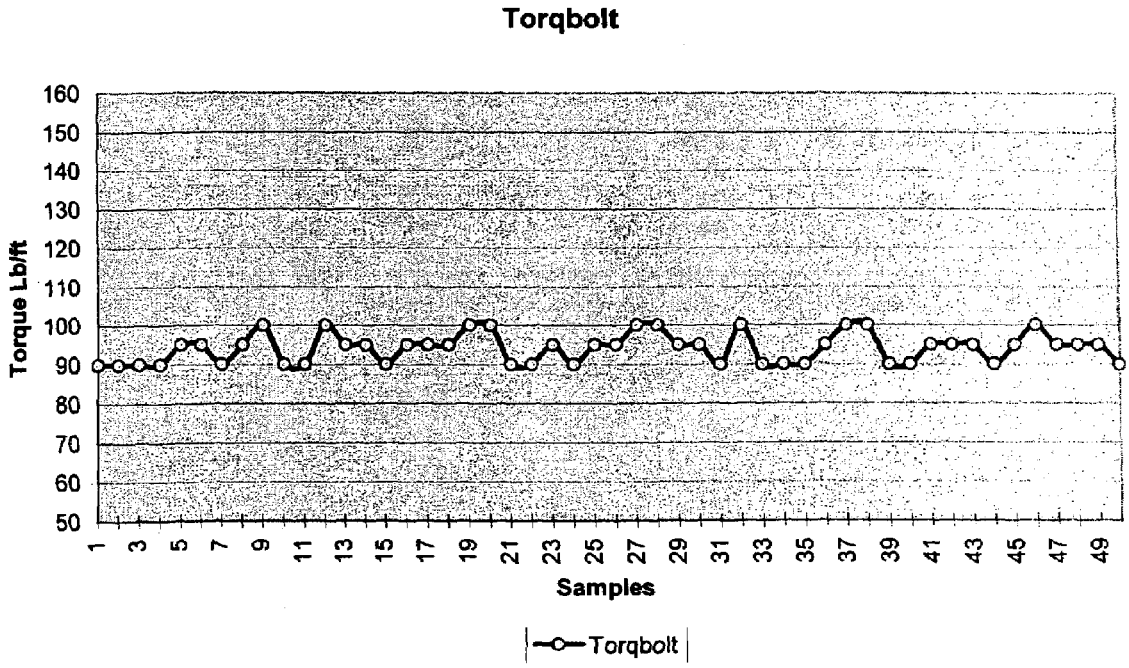
FIG. 7 shows the test results for the present invention.

Test results were conducted on the preferred embodiment of the present invention which had a predetermined $torque_{shear}$ of 90 ft-lbs. FIG. 7 shows the test results and the consistency of failure across the sample taken.

Figure 8:
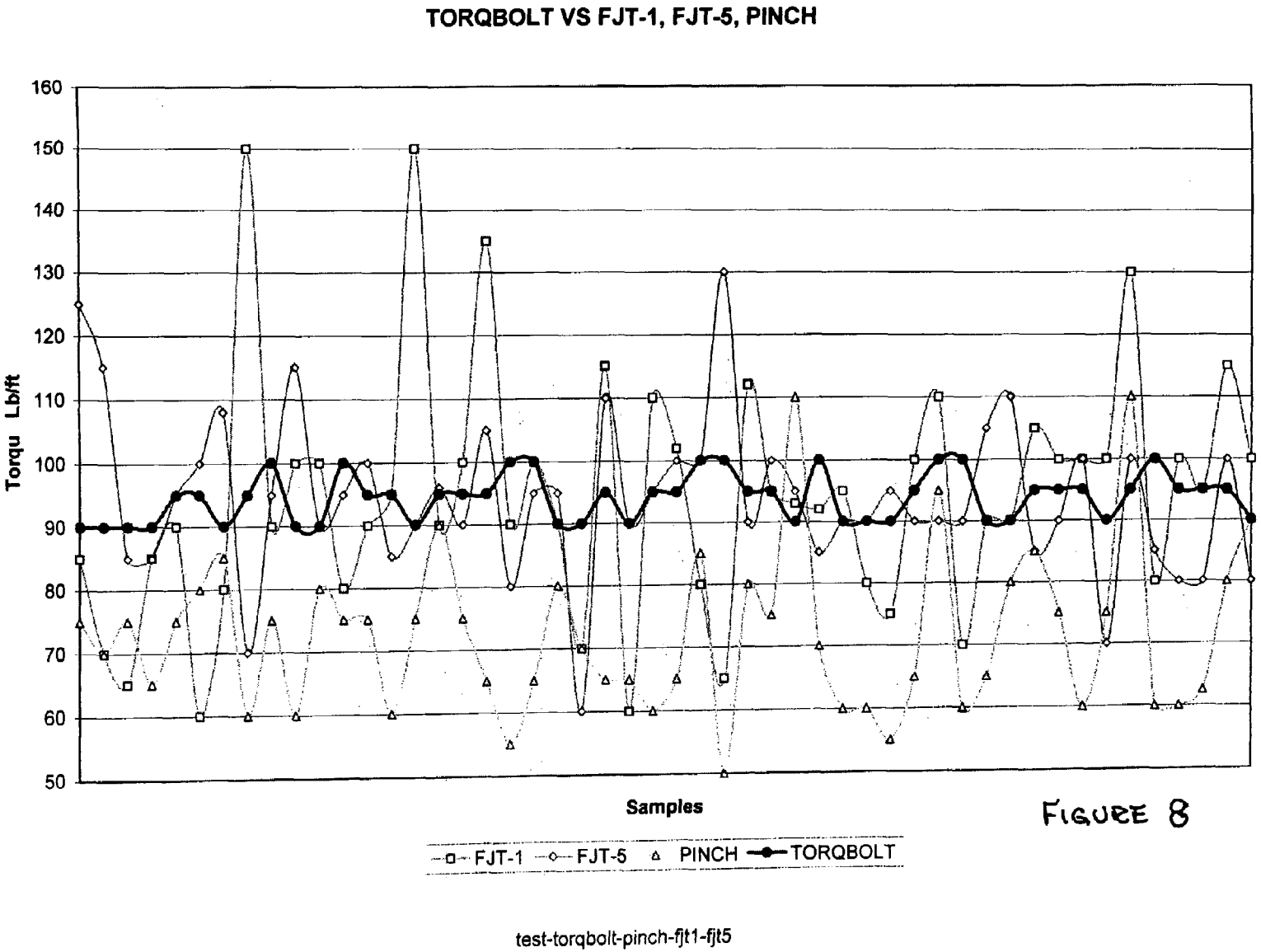
FIG. 8 shows combined test results highlighting the improvements of the present invention.

The combined test results are shown in FIG. 8, and clearly illustrate the vast improvement provided by the present invention. The $torque_{shear}$ of the present invention is very consistent across all samples tested having a standard deviation of only 3.7 ft-lbs between samples.

Description of the Preferred Embodiment of the Invention

Figure 9:
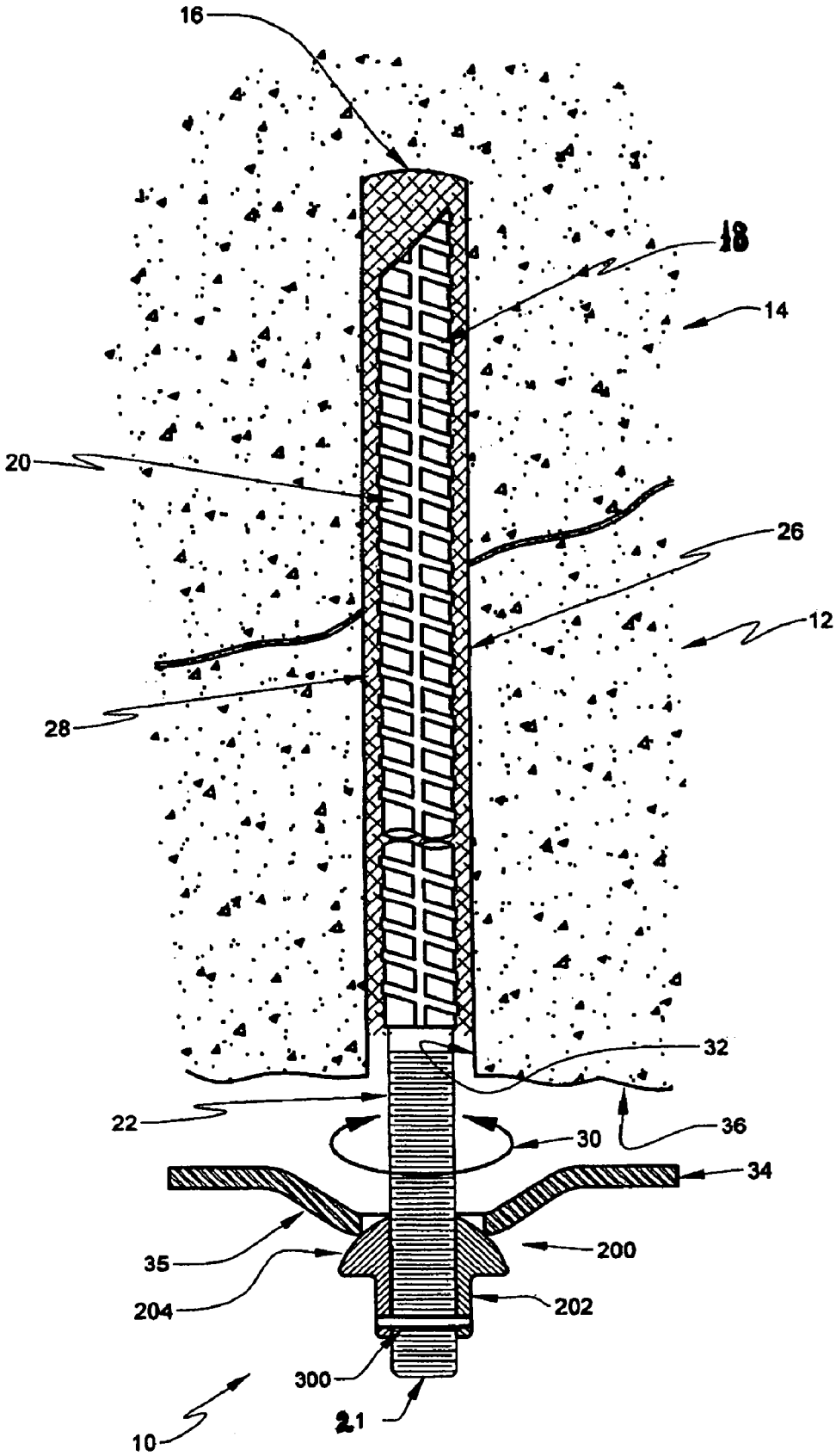
FIG. 9 shows a preferred embodiment of the present invention in a pre-torque$_{shear}$ position.

Referring to FIG. 9 there is shown a preferred embodiment of the improved ground support apparatus. The invention, generally designated as (10) is used for anchoring unstable rock formations (12) to stable rock formations (14) in mining operations. The invention shown is in its pre-$torque_{shear}$ state with nut (200) in its first temporary operation position fixed to the end of the threaded section (22) of the reinforcing member. (18). The invention is adapted to be inserted into a drilled hole (16) that extends through the unstable portion (12) to a stable portion (14) of the rock formation as might be found in the roof or wall of a mine tunnel. The invention comprises a tensionable reinforcing member (18) that is tubular in shape having a ribbed portion (20) and a threaded portion (22) at the opposite end of the ribbed portion. The threaded portion (22) has a free end (21) that extends from the drilled hole when installed. The member (18) has a longitudinal axis and a diameter. In alternative embodiments of the invention the reinforcing member may comprise one of a steel member or a cable. The portion inserted into the drilled hole may be smooth or textured to promote adhesion to the adhesion material. As shown in FIG. 9, the diameter of the reinforcing member (18) is less than the diameter of the drilled hole (16). This forms an annulus (26) around the member (18). The annulus is filled with a suitable hardenable adhesion material (28) such as a polyester resin. The resin may be inserted into the drilled hole prior to insertion of the member as binary packages so that when the member is inserted into the hole the packages are ruptured and their contents mix and cure into a hardened resin. Alternatively, the resin may be formulated in such a way that it can be pumped onto the annulus after the reinforcing member is inserted and mixed and cured by rotation (30) of the member (18) in the drilled hole. The ribbed portion (20) facilitates the fixing of the adhesion material to the member (18). The adhesion material (28) can also be a cementatious material depending upon the nature of the installation and the type of rock. The adhesion material (28) operatively connects the tensionable steel reinforcing member (18) to the wall (32) of drilled hole (16) permitting the transfer of forces between the member and the rock formation through the adhesion material. As shown in this preferred embodiment of the invention, the entire ribbed portion (20) of the bar and a small section of threaded portion (22) is inserted into the drilled hole (16). This permits bearing plate (34) to be placed in a tight abutting relationship with the face of the rock formation (36). Bearing plate (34) is adapted to move freely along the length of the threaded portion (22) of the reinforcing bar so that as nut (200) is advanced along threaded portion (22), the bearing plate can be forced into an abutting relationship with the rock face and compressive forces applied to the rock formation. It is understood that multiple bearing plates and washers can be installed between nut (200) and the rock face (36) as required. Also shown in FIG. 9 is at least one first bore (300) transversing the threaded portion (22) of the reinforcing member (18). Additional bores may be added to the threaded portion of the member to suit the needs of the installation.

Nut (200), shown in cross-section in FIG. 9, has a squared portion (202) and a convex hemispherical portion (204). The square portion of the nut is easily adapted for engagement with a nut driver or other rotation imparting device. As well, the corners of a square nut, as compared to, say, a hexagonal nut, are more resistive to shearing forces generated when large amounts of torque are applied to the nut such as during tensioning of the member (18). The convex curved face of the hemispherical portion (204) of nut (200) combined with the dome shaped (35) bearing plate (34) permits the installation of the member (18) at angles that depart from the vertical. As well, the ability of the domed bearing plate (34) to pivot over the convex face of the nut (200) permits installation of a vertical member where the rock face (36) is not horizontal.

Figure 10:
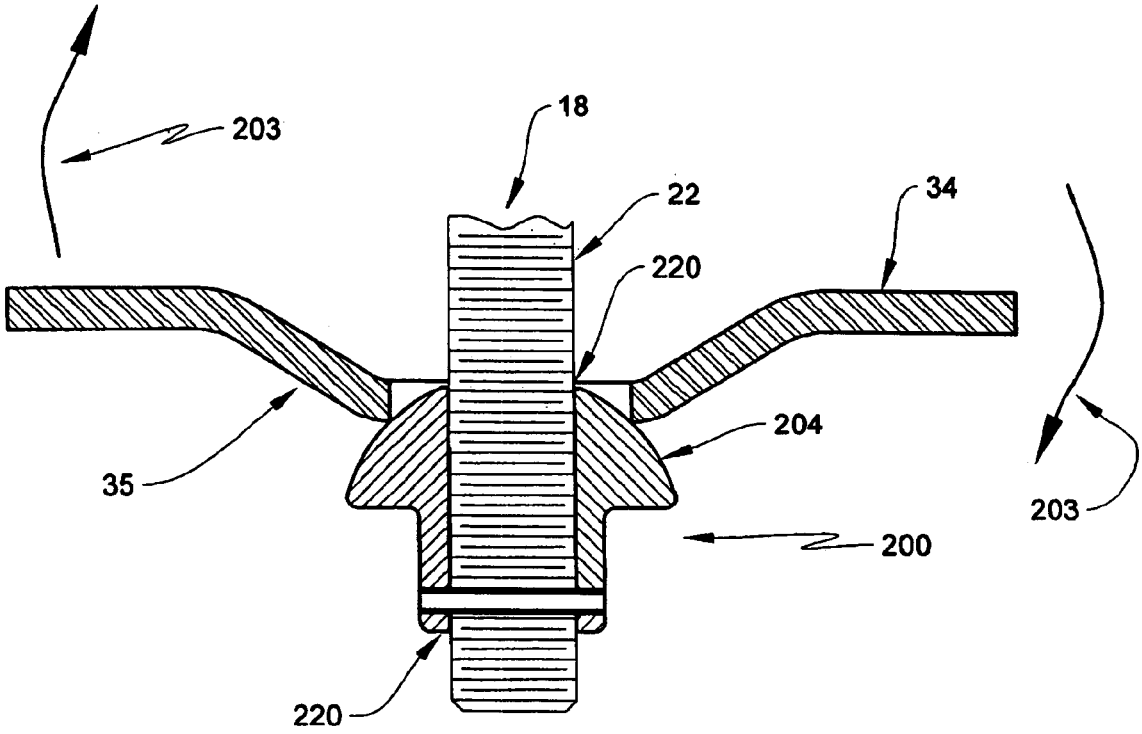
FIG. 10 illustrates the nut and the bearing plate of the present invention.

Referring to FIG. 10 there is illustrated in sectional side view nut (200) and bearing plate (34) used in a preferred embodiment of the present invention. The nut (200) is threadably received onto the threaded portion (22) of the reinforcing bar (18). Bearing plate (34) is illustrated abutting confrontationally against the convex portion (204) of nut (200). The domed portion (35) of the bearing plate (34) is adapted to pivot across the convex face of the hemispherical portion (204) of nut (202) to adapt to various angles of insertion of member (18) as shown by arrows (203).

Still referring to FIG. 10, nut (200) includes a second bore (220) that extends axially through the body of the nut. Second bore (220) is threaded and adapted for a threading engagement with the threads of threaded portion (22) of reinforcing member (18).

Figure 11:
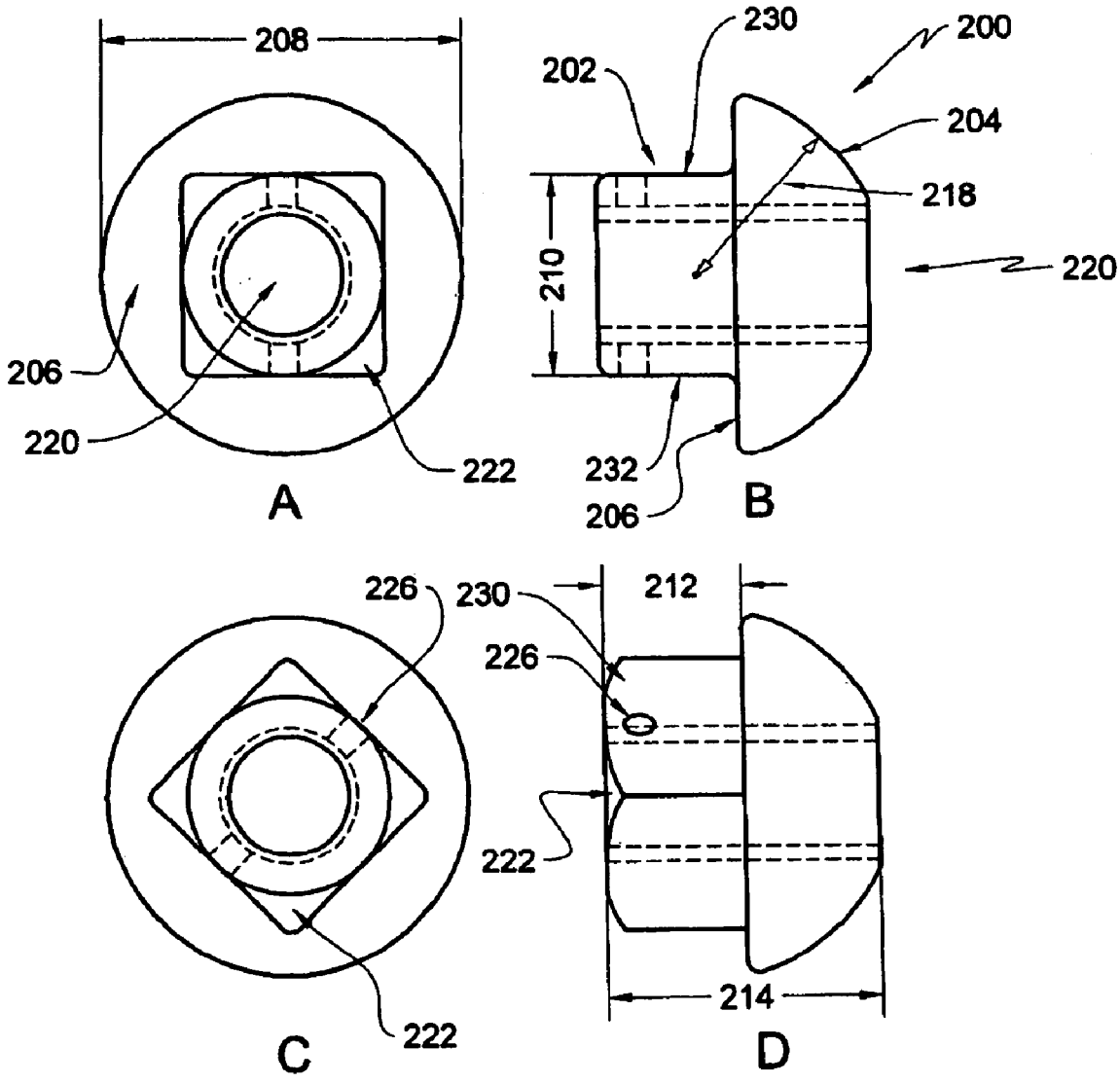
FIG. 11 illustrates various views of the nut of the preferred embodiment of the invention.

The nut (200) is further depicted in FIG. 11 showing views A, B, C, and D. The nut (200) has a unique unibody construction comprising a squared portion (202) and a convex hemispherical portion (204). Circumferential shoulder (206) is adapted to abut against rotation means (350) as more fully described in FIG. 14. The nut is molded from suitable material such as perlitic malleable iron grade 5005 or C-1035 steel. The convex hemispherical portion (204) of the nut (200) has a maximum diameter (208) of about 2 inches. Squared portion (202) has a width (210) of about 1.1 inches and an axial length (212) of about 0.75 inches. The axial length (214) of the nut is about 1.475 inches. The curvature of the hemispherical portion (204) has a radius (218) of about 1.022 inches. The nut has axial second bore (220) and is threaded with ¾-10 UNC LH class B threads. The threads are have a pitch diameter between 0.6880 and 0.6995 inches and are oversized by 0.003 inches. In an alternate embodiment the open end of the second bore (220) at the convex end of the nut may be bevelled to permit easy engagement between the threads of the nut and the threads of the reinforcing bar. The bevel is at an angle of about 45 degrees and is ⅛ inches deep. The squared portion (202) of nut (200) further includes bevels (222) on each corner having a radius of 0.063 inches. These bevels permit easy engagement between the nut and the rotation device. The nut has at least one third bore (226) that is located in the squared portion of the nut and intermediate the axial length (218) of the squared portion of the nut. The third bore transverses one face (230) of the squared portion of the nut to the opposite face (232) of the squared portion of the nut. The squared portion of the nut may accept more than one third bore (226) without degrading its strength. Third bore has a diameter of about 5/32 inches and is adapted to accept a rolled steel spring member as a shearing element as more fully described below.

Figure 12:
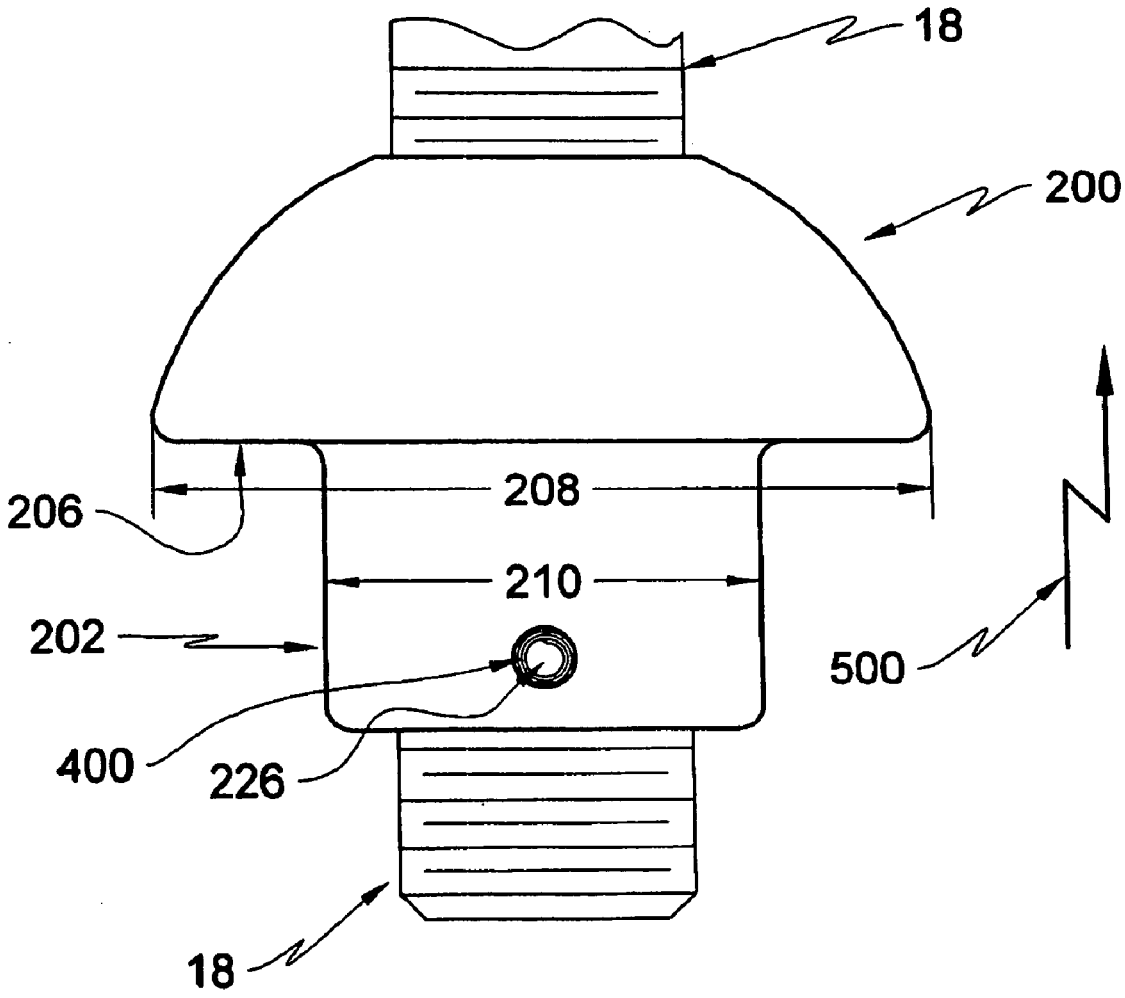
FIG. 12 illustrates the nut of the preferred embodiment of the invention showing the shearing element.

Referring now to FIGS. 9 and 12, there are shown views of the nut (200) threaded onto reinforcing member (18). The arrow (500) in FIG. 12 points towards the rock face (36). There is third bore (226) that penetrates the nut (200) squared body (202). There is also shown first bore (300) that transverses the threaded section (22) of the reinforcing member (18). First bore (300) may be placed anywhere along the treaded section (22) as necessitated by operating conditions. When the nut (200) is fixed in its first position third bore (226) and first bore (300) are co-axial so that shearing element (400) can be inserted into both to fix the nut in its temporary first position.

Figure 13:
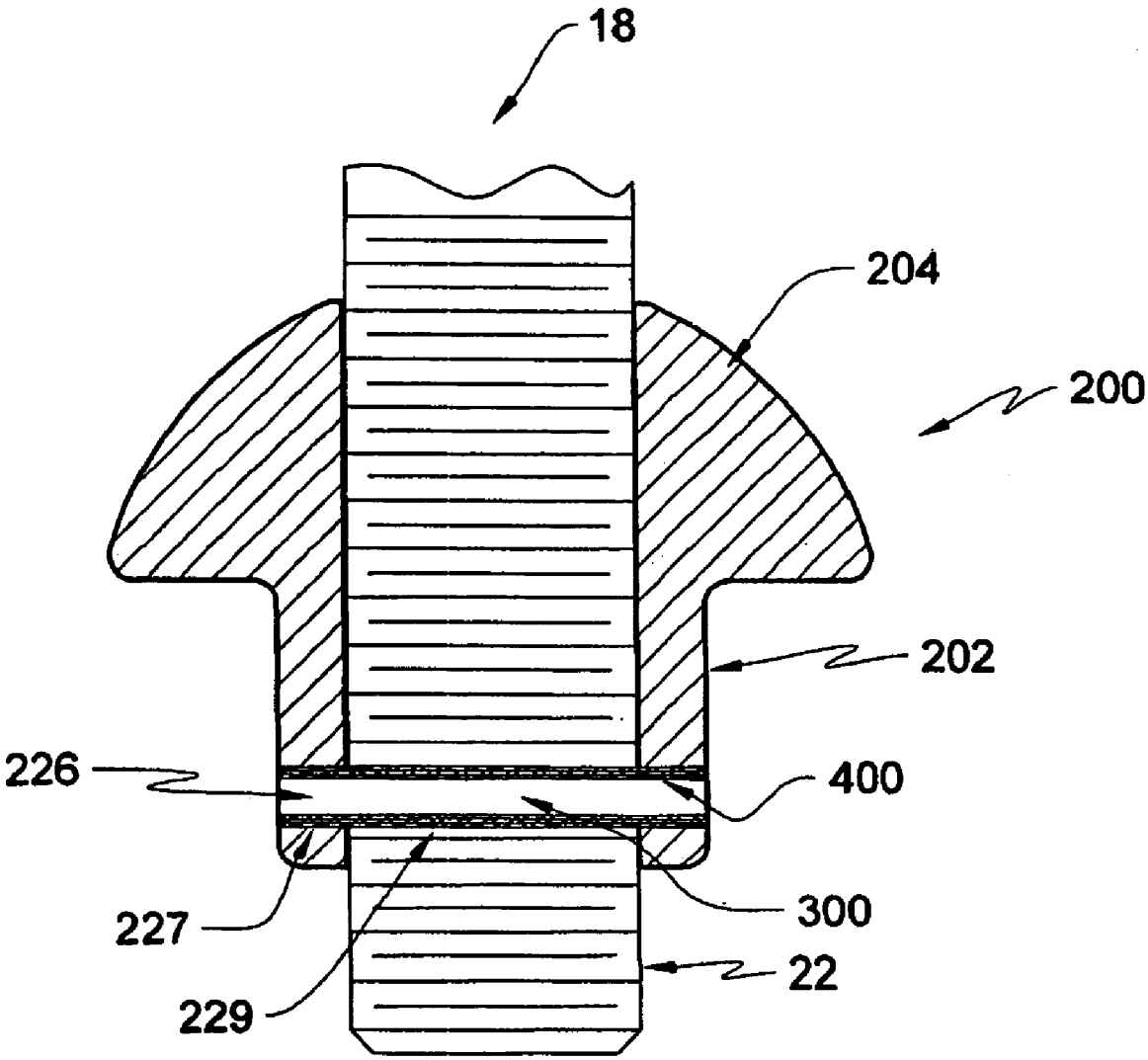
FIG. 13 shows, in cross section, the nut and the reinforcing member in the position of pre-torque$_{shear}$.

Referring to FIGS. 12 and 13 there is shown detail of the shearing element (400) used in the preferred embodiment of the invention. FIG. 13 shows a cross section of nut (200), third bore (226) through the squared body (202) of the nut, member (18) and first bore (300) through the threaded portion (22) of the member (18). Third bore (226) and first bore (300) are co-axial and shearing element (400) is inserted therein to fix the nut in its first temporary position. The shearing element (400) is a rolled steel spring member as indicated by the convolutions in FIG. 12 and the layers in FIG. 13. Shearing element (400) fits within the length of the combined bores (226) and (300) and does not extend beyond the outer edges of the bore (226). Shearing element (400) is manufactured from carbon steel. In its first unbiased state, shearing element (400) has a diameter that is slightly larger than the diameter of the aligned bores (226 and 300). The compressibility of shearing element (400) permits the shearing element to adopt a compressed configuration. The resulting compressed configuration has a diameter slightly smaller than the diameter of the aligned bores (226) and (300) so that the shearing element slides easily into the bores while a compressive force maintained on the shearing element. Once the shearing element is placed within the aligned bores the compressive force is released and the shearing element is permitted to expand into the diameter of the aligned bores. Since the diameter of the bores is less than the diameter of the shearing element in its unbiased state, a significant biasing force is generated by the shearing element against the inside walls (227) and (229) of the aligned bores (226) and (300) respectively. This biasing force has two advantages: prior to shearing the shearing element will remain stationary within the bores and will not drop out and be lost or be displaced by agitation; and, after shearing element has been sheared the residual portion of the sheared element continues to exert a biasing force it will remain with its respective bore after shearing. This prevents pieces of the shearing element becoming jammed in the threads and damaging the threads and prevents the pieces of the shearing elements from causing a safety hazard to nearby workers. In the preferred embodiment of the invention the shearing element is made from carbon steel (1070–1095) and has an expanded diameter of between 0.163 inches and 0.171 inches. The length of the shearing element is 1.125 inches and the thickness of the steel used is about 0.012 inches. While the preferred embodiment of the shearing element has been described above and provided the best operating results, the invention will operate with satisfactory results using a variety of compressible shearing elements.

Figure 14:
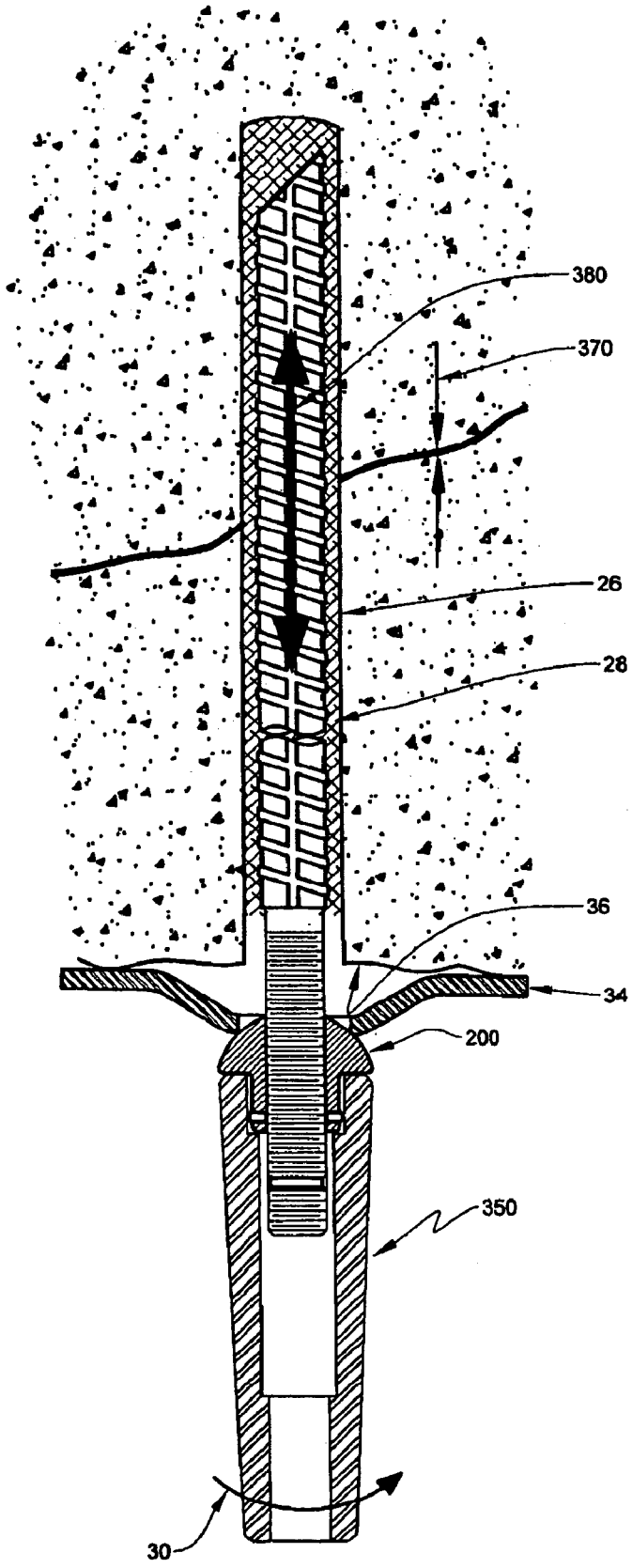
FIG. 14 shows the invention in its position of torque$_{max}$.

Referring to FIGS. 9 and 14, the nut (200) has a first pre-torque$_{shear}$ temporary operating position as illustrated in FIG. 9 and a second post-torque$_{shear}$ operating position as illustrated in FIG. 14. In FIG. 9, the nut (200) is fixed to the threaded portion of the member (22) by the shearing element (400) located within axially aligned third bore (226) and first bore (300). Nut (200) and member (18) are rotatable together as a single unit. Nut (200) will be coupled to at least one nut rotation device (350) to impart a rotation (30) to the nut and member. Therefore, with the nut in its first temporary operating position, the ribbed portion (20) of the member (18) is inserted into the drilled hole (16) with the adhesion material (28) placed in the drilled hole prior to insertion of the member or after insertion of the member. Sufficient torque is applied to nut (200) so as to rotate the member thus agitating the adhesion material (28) so that it mixes in annulus (26). The nut and member may be rotated clockwise or counter clockwise as desired. As the adhesion material cures it becomes stiffer and more difficult to rotate the member within the material. Therefore, additional torque must be applied to the nut. At a predetermined torque$_{shear}$ applied to the nut selected to coincide with the cured stiffness of the adhesion material used, the shearing element will fail permitting nut (200) to rotate freely along the threads of the member (18) to assume its permanent post-torque$_{shear}$ position shown in FIG. 14. Since the remnants of the shearing element (400) do not interfere with the threads there is negligible residual torque on the nut as it advances towards the rock face (36). The nut and bearing plate (34) are then advanced along the length of the member so that the bearing plate comes into abutting contact with the rock face (36). Adhesion material (28) in annulus (26) has cured to a desired hardness so that stabilizing forces can be transmitted between the rock formation and the reinforcing member (18). In this configuration, a predetermined amount of torque is added to nut (200) to tension the reinforcing member. The amount of torque$_{max}$ is dependent upon the length of the reinforcing member, the type of adhesion material used and the application of the system. As it is torqued, nut (200) forces plate (34) against rock face (36), which in turn exerts compressive forces (370) between the unstable rock (12) and the stable rock (14). The torquing of nut (200) also creates tension forces (380) in the reinforcing member (18) now anchored to the stable rock (14) by the adhesion material (28) further adding stability to the rock formation.

After the shearing element (400) has sheared, remnants remain within their respective bores to prevent safety hazards to the workers and damage to the threads (22). Therefore, additional items may be added to the threaded portion (22) as desired. For example, a second square nut may be placed on the member (18) and torqued behind the first nut (200) in order to affix a screen to the end of the member (18).

Figure 15:
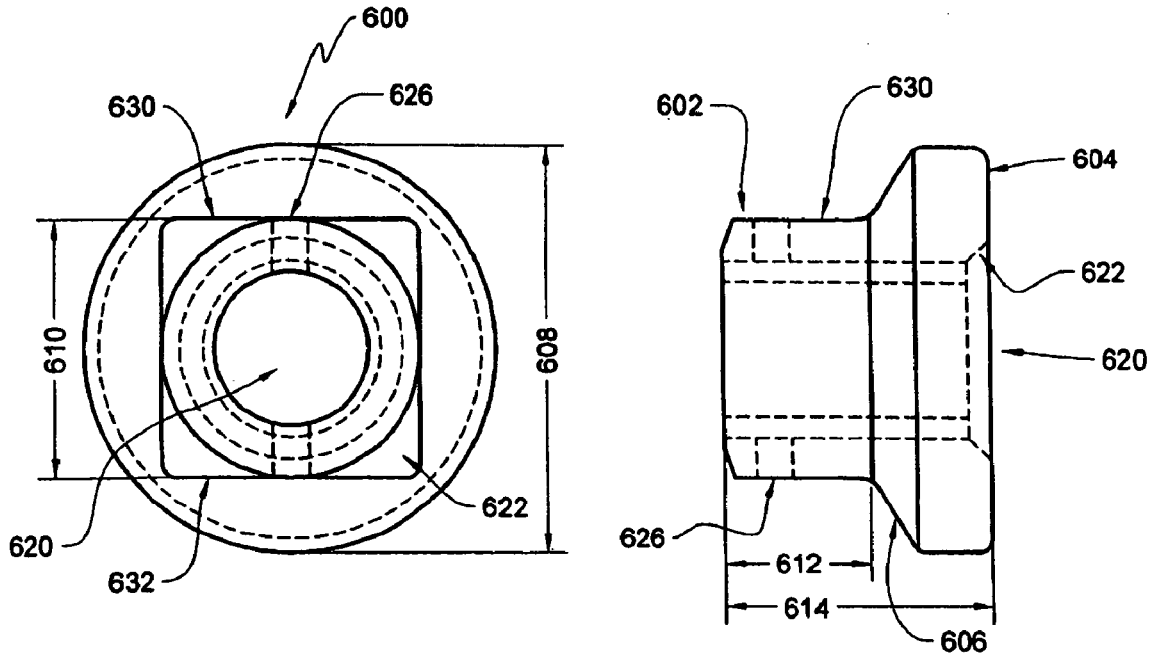
FIG. 15 shows an alternative embodiment of the nut.

An alternative embodiment of the present invention is shown in FIG. 15 and is know as the flange nut. The nut (600) is depicted in views A and B. The nut (600) has a unibody construction comprising a squared portion (602) and a flanged portion (604). Circumferential bevelled shoulder (606) is adapted to abut against rotation means (350). The nut is molded from suitable material such as perlitic malleable iron grade 5005 or C-1035 steel. The flange portion (604) of the nut (600) has a maximum diameter (608) of about 1.75 inches. Squared portion (602) has a width (610) of about 1.1 inches and an axial length (612) of about 0.625 inches. The axial length (614) of the nut is about 1.13 inches. The nut has axial bore (620) and is threaded with ¾-10 UNC LH class B threads. The threads are have a pitch diameter between 0.6880 and 0.6995 inches and are oversized by 0.003 inches. In an alternate embodiment the open end of the second bore (620) at the flanged end of the nut may be bevelled (622) to permit easy engagement between the threads of the nut and the threads of the reinforcing bar. The bevel is at an angle of about 45 degrees and is ⅛ inches deep. The squared portion (602) of nut (600) further includes bevels (622) on each corner having a radius of 0.063 inches. These bevels permit easy engagement between the nut and the rotation device. The nut has at least one third bore (626) that is located in the squared portion of the nut and intermediate the axial length (618) of the squared portion of the nut. The bore transverses one face (630) of the squared portion of the nut to the opposite face (632) of the squared portion of the nut. The squared portion of the nut may accept more than one bore third (626). Third bore has a diameter of about 5/32 inches and is adapted to accept a rolled steel spring member as a shearing element as more fully described above.

Figure 16:
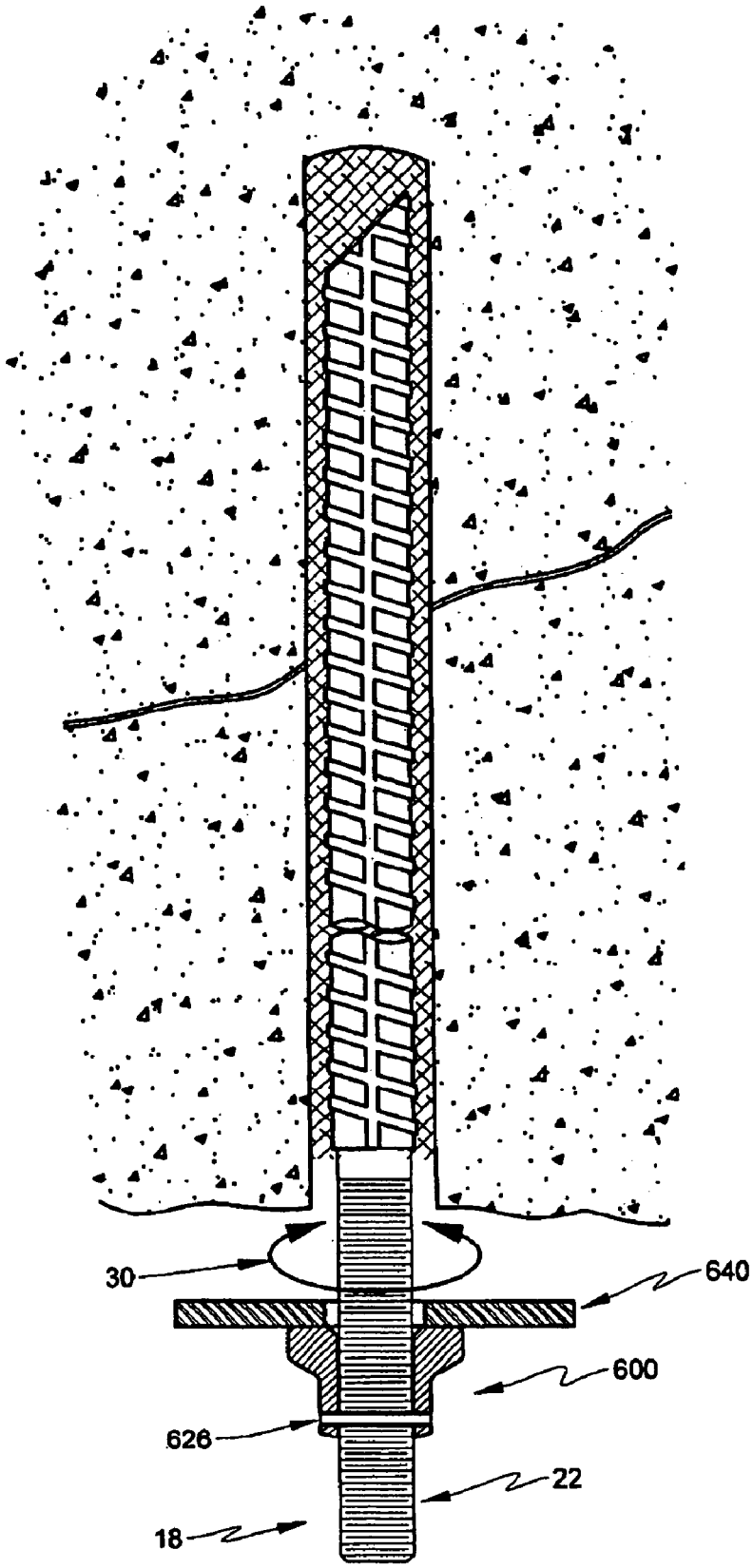
FIG. 16 shoes the alternative embodiment of the nut and flat washer combination in an invention in a pre-torque$_{shear}$ position.
Figure 17:
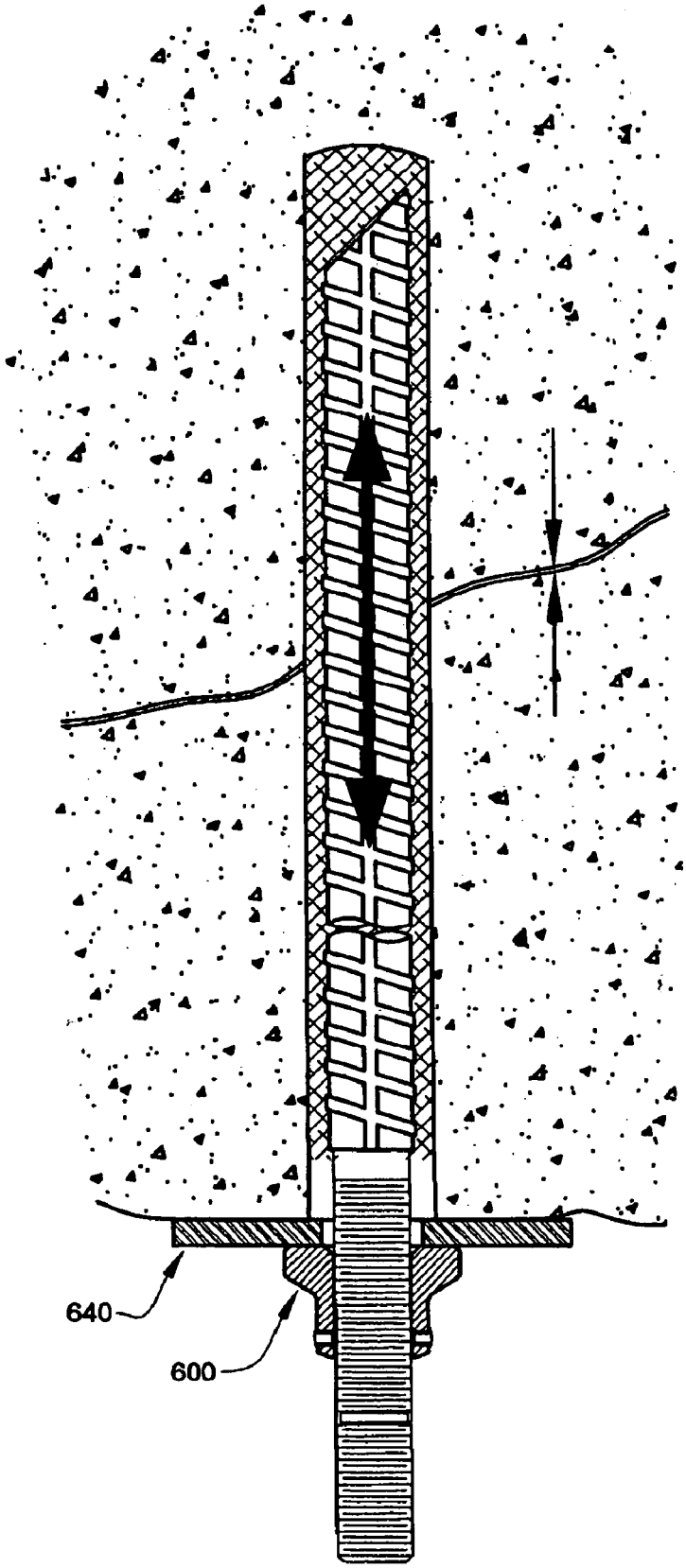
FIG. 17 shows an alternative embodiment of the nut and flat washer combination in a torque$_{max}$ position.

The flange nut (600) is employed with flat washers (640). This most often occurs when the rock face is substantially flat and the installation is vertical. FIG. 16 shows the flange nut in its first pre-torque$_{shear}$ position and FIG. 17 shows the flange nut in its torque$_{max}$ position. The operation of the apparatus from its pre-torque$_{shear}$ first temporary operating position to its second permanent post torque$_{shear}$ position has been previously described with respect to FIGS. 9 and 14.

Sales of the Invention

FIG. 18 illustrates the sales of the invention since its first sale. Sales have been consistently strong since inception. These figures show that the invention enjoys great commercial success in the marketplace, fills a long felt want in the marketplace for the invention and is both novel and inventive over the known art. The value of the total sales to date is approximately $500,000.00 Canadian.

The present invention has demonstrated the following advantages that have lead to the impressive commercial success in the marketplace:

- The torque$_{shear}$ is consistent between all samples of the improved apparatus for ground support.
- The improved apparatus does not cause thread damage.
- The improved apparatus does not create worker hazards.
- The nut can be set anywhere on the threaded portion of the reinforcing member and this gives the worker the option of determining what length of threaded member remains outside of the drilled hole. This also permits the further installation of additional hardware over the extending threaded end of the reinforcing member.
- The nuts stay in place when the improved apparatus is being transported to the work site.
- No special equipment is required to install the improved apparatus and any underground anchoring device can be used.

Although the description above contains many specifications, these should not be construed as limiting the scope of the invention but as merely providing illustrations of some of the presently preferred embodiments of this invention. Thus the scope of the invention should be determined by the appended claims and their legal equivalents rather than by the examples given.

What is claimed is:

1. An improved apparatus for ground support rotatable by rotation means, said improved apparatus adapted for insertion into a drilled hole penetrating a rock face, the improved apparatus comprising:

a. a tensionable reinforcing member comprising:

i. a longitudinal axis;

ii. a diameter;

iii. a first end threaded portion having a tree end and a first length, wherein said first end threaded portion extends out of said drilled hole;

iv. a second end ribbed portion having second length, wherein said second length of said second end ribbed portion is adapted for total placement within the drilled hole;

v. at least one first bore, wherein said at least one first bore has a diameter and an inside surface, and wherein the at least one first bore is positionable intermediate of said first length of the first end threaded portion, and wherein the at least one first bore transverses the diameter of the first end threaded portion, and further wherein the at least one first bore is perpendicular to said longitudinal axis;

b. at least one nut threadably receivable by the tensionable reinforcing member first end threaded portion, said at least one nut having a body, said body comprising:

i. a squared portion having an axis, a first axial length, and a first width, wherein said squared portion is adapted to engage said rotation means;

ii. a convex hemispherical portion, adjacent to, coaxial with and integral to said squared portion wherein the convex hemispherical portion permits installation of the tensionable reinforcing member when said rock face is uneven;

iii. a second bore having a diameter, wherein said second bore extends co-axially trough the squared portion and said hemispherical portion of the at least one nut body, wherein said second bore is adapted for threaded engagement with the first end threaded portion of the tensionable reinforcing member;

iv. at least one third bore having a diameter equal to the diameter of the at least one first bore and an inside surface, said at least one third bore transversing the squared portion of the at least one nut body, the at least one third bore positioned intermediate of the axial length of the squared portion of the at least one nut body, and further wherein the at least one third bore and the at least one first bore are axially alignable when the at least one nut body is engaged with the first end threaded portion of the tensionable reinforcing member;

c. at least one bearing plate used in combination with the at least one nut, said at least one bearing plate having a central domed portion and a circular aperture positioned centrally within said central domed portion, wherein the at least one bearing plate is adapted for placement upon the first end threaded portion of the tensionable reinforcing member, and wherein the at least one bearing plate is positianable between the rock face and the at least one nut convex hemispherical portion so that the central domed portion is adjacent to and in confronting relation to the at least one nut convex hemispherical portion, and further wherein said central domed portion circular aperture is adapted for pivoting engagement with the convex hemispherical portion of the at least one nut thereby permitting use of the improved apparatus on uneven rock faces; and, d. at least one shearing element comprising a rolled spring member manufactured from carbon steel adapted to shear at a predetermined torque$_{shear}$, said at least one shearing element placed within the axially aligned at least one first bore and at least one third bore thereby temporarily fixing the at least one nut adjacent to said free end of the first end threaded portion of the tensionable reinforcing member, and further wherein the rolled spring member fails consistently at said predetermined torque$_{shear}$.

2. The improved apparatus of claim 1 wherein the at least one nut body includes a circumferential shoulder between the squared portion of the at least one nut and the convex hemispherical portion of the at least one nut, said circumferential shoulder adapted to abut against the rotation means.

3. The improved apparatus of claim 2, wherein the squared portion of the at least one nut body is sufficiently dimensioned so that the at least one third bore does not degrade the strength of the at least one nut body.

4. The improved apparatus of claim 3 wherein the at least one nut has a first pre-torque$_{shear}$ temporary operation position adjacent to the free end of the first end threaded portion of die tensionable reinforcing member.

5. The improved apparatus of claim 4 wherein the at least one nut has a second post-torque$_{shear}$ permanent operating position located adjacent to the rock face.

6. The apparatus of claim 5 wherein the at least one nut has a third torque$_{max}$ position located adjacent to the rock face and adapted for the transmission of tensile forces into the tensionable reinforcing member.

7. The improved apparatus of claim 6 wherein the rotation means engages the at least one nut in said first pre-torque$_{shear}$ temporary operation position, and wherein the rotation means applies torque$_{shear}$ to the nut thereby failing the shearing element, thereby permitting the nut to advance from the first pre-torque$_{shear}$ temporary operation position to said second post torquepermanent operation position.

8. The improved apparatus as claimed in claim 1, wherein said rolled spring member has a variable diameter, and wherein the rolled spring member has:

a. a first unbiased state having a first unbiased state diameter, wherein said first unbiased diameter is larger than the diameter of the aligned at least one firs bore and the at least one third bore;

b. a second fully biased state having a second frilly biased state diameter, wherein said second fully biased state diameter is smaller than the diameter of the aligned at least one first bore and the at least one third bore, so that the rolled spring member can be inserted completely into the aligned at least one first bore and the at least one third bore; and, c. a third partially biased state having a third partially biased state diameter, wherein said third partially biased state diameter expands to fill the aligned at least one first bore and at least one third bore, and further wherein the rolled spring member exerts a biasing force against the inside surface of the aligned at least one first bore and the at least one third bore.

9. The improved apparatus of claim 8 wherein the rolled spring member is able to consistently shear at a predetermined torque$_{shear}$.

10. An improved apparatus for ground support rotatable by rotation means, said improved apparatus adapted for insertion into a drilled hole penetrating a rock face, the improved apparatus comprising:

a. a tensionable reinforcing member comprising:

i. a longitudinal axis;

ii. a diameter;

iii. a first end threaded portion having a tree end and a first length, wherein said first end threaded portion extends out of said drilled hole;

iv. a second end ribbed portion having second length, wherein said second length of said second end ribbed portion is adapted for total placement within the drilled hole;

v. at least one first bore, wherein said at least one first bore has a diameter and an inside surface, and wherein the at least one first bore is positionable intermediate of said first length of the first end threaded portion, and wherein the at least one first bore transverses the diameter of the first end threaded portion, and further wherein the at least one first bore is perpendicular to said longitudinal axis;

b. at least one molded flange nut threadably receivable by the tensionable reinforcing member first end threaded portion, said at least one molded flange nut comprising:

i. a squared portion adapted to engage said rotation means;

ii. a beveled flanged portion adjacent to said squared portion and adapted to exert pressure against said rock face;

iii. a circumferential beveled shoulder between said beveled flange portion and the squared portion, wherein said circumferential beveled shoulder is adapted to abut against the rotation means;

iv. a second bore having a diameter and extending do-axially through the at least one molded flange nut, said second bore adapted for threaded engagement wit the first end threaded portion of the tensionable reinforcing member; and, v. at least one third bore located in the squared portion of the at least one molded flange nut intermediate the axial length thereof and transversing the square portion;

c. at least one flat bearing plate used in combination with at least one molded flange nut, said at least one flat bearing plate having a circular aperture positioned centrally there within, wherein the at least one flat bearing plate is adapted for placement upon the first end threaded portion of the tensionable reinforcing member between the rock face and the at least one molded flange nut; and, d. at least one shearing element comprising a rolled spring member manufactured from carbon steel and having a variable diameter and adapted to shear at a predetermined torque$_{shear}$, wherein the at least one shearing element is placed within the axially aligned at least one first bore and at least one third bore thereby temporarily fixing the at least one molded flange nut adjacent to said free end of the first end threaded portion of the tensionable reinforcing member, and further wherein the rolled spring member fails consistently at a predetermined torque$_{shear}$.

11. In an improved apparatus for ground support rotatable by rotation means, said improved apparatus adapted for insertion into a drilled hole penetrating a rock face, the improved apparatus comprising:

a. a tensionable reinforcing member comprising:

i. a longitudinal axis;

ii. a diameter;

iii. a first end threaded portion having a free end and a first length, wherein said first end threaded portion extends out of said drilled hole;

iv. a second end ribbed portion having a second length, wherein said second length of said second end ribbed portion is adapted for total placement within the drilled hole;

v. at least one first bore, wherein said at least one first bore has a diameter and an inside surface, and wherein the at least one first bore is positionable intermediate of said first length of the first end threaded portion, and wherein the at least one first bore transverses the diameter of the first end threaded portion, and further wherein the at least one first bore is perpendicular to said longitudinal axis;

b. at least one nut threadably receivable by the tensionable reinforcing member first end threaded portion, said at least one nut having a body, said body comprising:

i. a squared portion having an axis, a first axial length, and a first width, wherein said squared portion is adapted to engage said rotation means;

ii. an convex hemispherical portion, adjacent to, coaxial with and integral to said squared portion wherein the convex hemispherical portion permits installation of the tensionable reinforcing member wherein said rock face is uneven;

iii. a second bore having a diameter, wherein said second bore extends co-axially through the squared portion and said hemispherical portion of the at least one nut body, wherein said second bore is adapted for threaded engagement with the first end threaded portion for the tensionable reinforcing member;

iv. at least one third bore having a diameter equal to the diameter of the at least one first bore and an inside surface, said at least one third bore transversing the squared portion of the at least one nut body, the at least one third bore positioned intermediate of the axial length of the squared portion of the at least one nut body, and further wherein the at least one third bore and the at least one first bore are axially alignable when th&at least one nut body is engaged with the first end threaded portion of the tensionable reinforcing member;

c. at least one bearing plate used in combination with the at least one nut, said at least one bearing plate having a central domed portion and a circular aperture positioned centrally within said central domed portion, wherein the at least one bearing plate is adapted for placement upon the first end threaded portion of the tensionable reinforcing member, and wherein the at least one bearing plate is positionable between the rock face and the at least one nut convex hemispherical portion so that the central domed portion is adjacent to and in confronting relation to the at least one nut convex hemispherical portion, and further wherein said central domed portion circular aperture is adapted for pivoting engagement with the convex hemispherical portion of the at least one nut thereby permitting use of the improved apparatus on uneven rock faces; and, an improved shearing element comprising a rolled spring member manufactured from carbon steel adapted to shear at a predetermined $torque_{shear}$, said at least one shearing element placed within the axially aligned at least one first bore and at least one third bore thereby temporarily fixing the at least one nut adjacent to said free end of the first end threaded portion of the tensionable reinforcing member, and further wherein the rolled spring member fails consistently at said predetermined $torque_{shear}$.

* * * * *